US005988090A

United States Patent [19]

Barker, Jr.

[11] Patent Number: 5,988,090

[45] Date of Patent: Nov. 23, 1999

[54] STABILIZATION PONTOON SYSTEM FOR SMALL WATERCRAFT

[76] Inventor: Denver L. Barker, Jr., 37 Winster Fax, Williamsburg, Va. 23185

[21] Appl. No.: 08/946,273

[22] Filed: Oct. 7, 1997

[51] Int. Cl.[6] ..... B63B 43/14

[52] U.S. Cl. ..... 114/123; 114/283

[58] Field of Search ..... 114/123, 283

[56] References Cited

U.S. PATENT DOCUMENTS

| | | | |
|---|---|---|---|
| 655,234 | 8/1900 | Howe et al. . | |
| 1,100,044 | 6/1914 | Alexovic | 114/123 |
| 3,002,484 | 10/1961 | Dube | 114/123 |
| 3,064,370 | 11/1962 | La Fleur | 114/123 |
| 3,150,632 | 9/1964 | Evans . | |
| 3,929,085 | 12/1975 | Mason | 114/123 |
| 4,964,357 | 10/1990 | Genfan | 114/123 |
| 5,235,925 | 8/1993 | Farrier | 114/123 |

FOREIGN PATENT DOCUMENTS

| | | | |
|---|---|---|---|
| 1555762 | 12/1967 | France . | |
| 62-244790 | 10/1987 | Japan . | |
| 1761586 | 9/1992 | U.S.S.R. | 114/123 |

*Primary Examiner*—Jesus D. Sotelo
*Attorney, Agent, or Firm*—Dowell & Dowell, P. C.

[57] ABSTRACT

A stabilizing pontoon system adapted for use in small watercraft which includes a pair of vertically adjustable outriggers connected by a linkage system to an actuator and to each of which is mounted a pontoon which is lowered into the water to stabilize the watercraft but which may be incrementally elevated to reduce drag as the watercraft is moving through the water.

17 Claims, 5 Drawing Sheets

Fig. 4
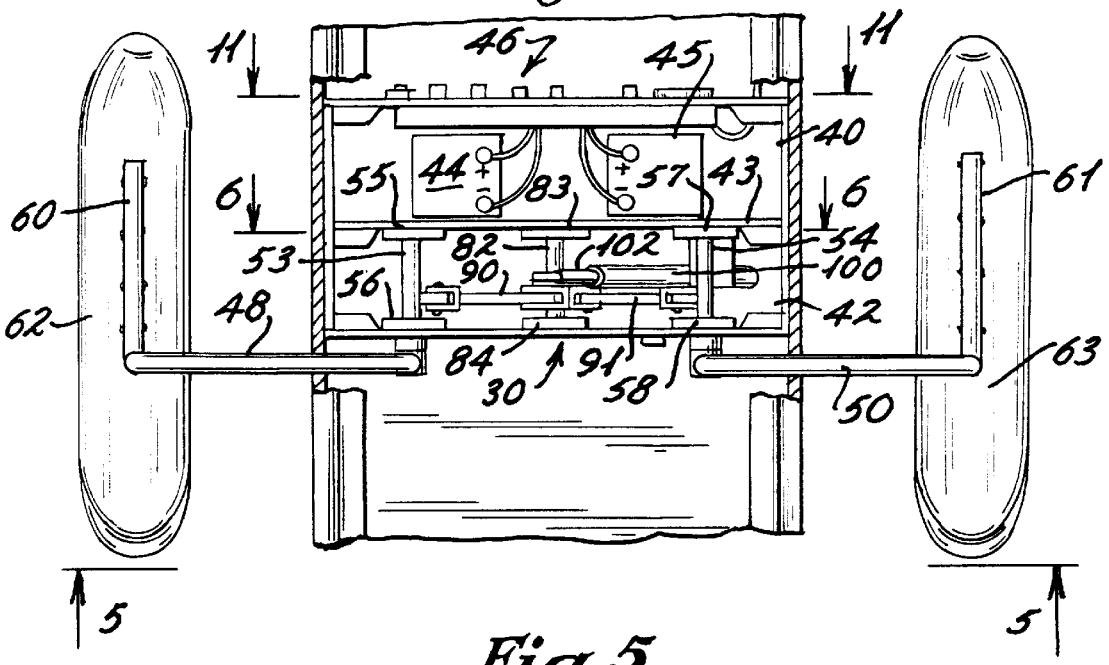
Fig. 5
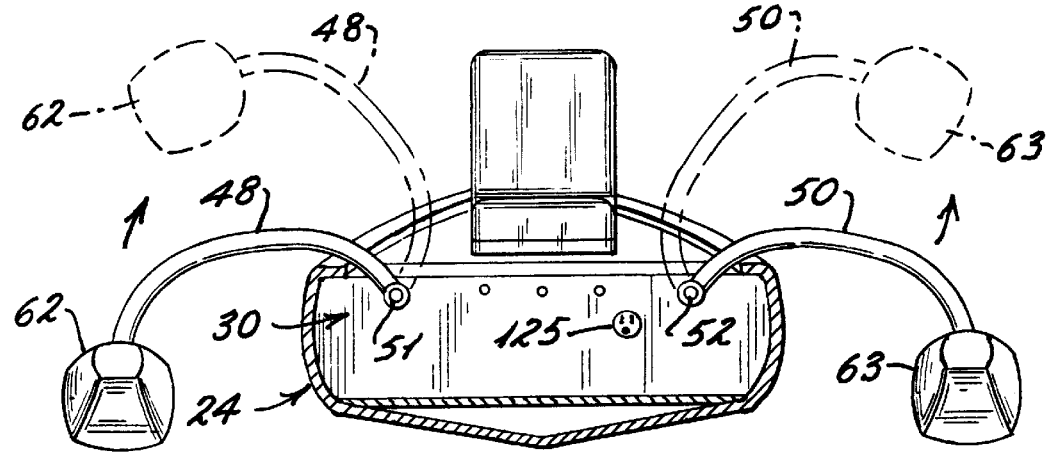
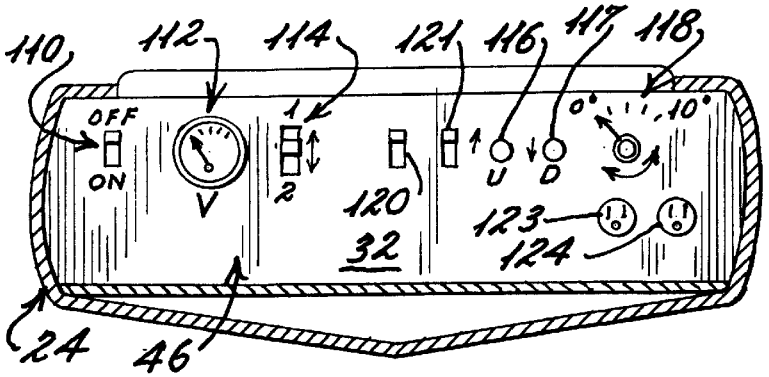
Fig. 12

STABILIZATION PONTOON SYSTEM FOR SMALL WATERCRAFT

BACKGROUND OF THE INVENTION

1. Field of the Invention

This invention is generally directed to stabilization devices for use with watercraft and more specifically to a stabilizing pontoon assembly which is designed to be easily installed within conventional small craft including canoes, Jon boats, rowboats, dinghies and the like in order to provide stabilization to the especially when such watercraft are stationary or moving at slow speed in the water.

2. History of the Related Art

Watercraft such as canoes, rowboats, Jon boats and the like are often utilized by sports fisherman because they are lightweight and easy to transport and may be compactly stored when not in use. Further, such small watercraft are more economical to purchase than other types of fishing craft and they are also very maneuverable in the water and may be utilized because of their minimum draft requirements to access areas where some boats can not be used. Further, because of their design, relatively small motors may be easily mounted to such watercraft to provide power for trolling and to otherwise facilitate maneuvering in the water. Unfortunately, because of their size and hull design, such smaller watercraft, and especially canoes, are extremely unstable in the water and can easily be tipped by people moving within the boat. The stability of canoes and other small watercraft is an important consideration for fishermen who are constantly casting and moving while fishing.

It has long been known that canoes and other boats may be stabilized using outriggers or pontoon structures mounted to arms which extend from the sides of the boat. In basic stabilizing systems, the outrigger arms are fixedly secured to the sidewall of a canoe or other boat such that the pontoons or floats associated with the outrigger arms are retained at a fixed vertical height relative to the sidewalls of the boats. This results in the creation of a drag force during the movement of the boats through the water and also reduces the maneuverability of the boats in the water.

An early improvement over the fixed structure of outriggers for use with small boats is disclosed in U.S. Pat. No. 655,234 to Howe et al. This patent discloses a pair of outrigger assemblies which may be mounted to the upper sidewalls of a small boat, such as a canoe, and which include special clamps which enable floats carried by the outriggers to be vertically adjusted by manipulating the clamps. In some instances, the floats may be raised slightly above the water so as to not interfere with the normal movement of the boat within the water, however, in other circumstances the clamps may be manually adjusted and the floats lowered so as to contact the water and provide stabilization for the boat.

Unfortunately, structures such as that disclosed in the patent to Howe et al. are not practical and do not allow convenient adjustment to the float or pontoons associated with the outriggers without undue physical movement being necessary to effect deployment or adjustment of the outriggers or the pontoons associated therewith.

Further, although vertical adjustment of the floats or pontoons associated with stabilization outriggers for small boats provides for a measure of stabilization, such adjustment does not adequately address the need for some degree of stabilization when a boat is moving through the water. Therefore, it would be preferred to provide a structure which enables selective surface contact to be made by changing the angle or pitch of a float or pontoon relative to the surface of the water depending upon the amount of maneuverability and stability required.

Some additional examples of pontoon assemblies for watercraft are disclosed in U.S. Pat. Nos. 1,100,044 to Alexovic, 3,002,484 to Dube, 3,064,307 to Lafleur, 3,150,632 to Evans, 3929,085 to Mason, 4,964,357 to Genfan and 5,235,925 to Farrier. In addition, other pontoon structures are disclosed in Japanese Patent 62-244790 of October 1987 and French Patent 1,555,762 of Jan. 31, 1969.

SUMMARY OF THE INVENTION

A stabilization assembly adapted for use with canoes and other small watercraft such as rowboats, towboats and the like. In a preferred embodiment, the assembly is constructed as a unit which may be easily mounted within the hull of a canoe or other watercraft and secured thereto with minimum or no alteration to the structure of the craft.

The stabilization system includes a housing in which are mounted a pair of pivot shafts which extends through suitable support bearings in walls of the housing. The shafts are spaced and generally parallel with respect to one another and have end portions which extend outwardly of the housing to a point of connection with outrigger arms which extend upwardly and outwardly relative to the housing so that, when the housing is placed within the hull of a watercraft, the outriggers extend outwardly beyond opposite sidewalls thereof. Mounted interiorly of the housing is a control mechanism, which, in the preferred embodiment, includes an extension rod which is mounted by suitable linkages to each of the pivot shafts. The mechanism may be gearing or an electrical cylinder, a pneumatic cylinder, or a fluid piston cylinder, however, in the preferred embodiment the cylinder is an electric cylinder having an extendable and retractable rod.

Mounted to the outer ends of each of the outrigger arms are elongated pontoons which may have varying configurations. The pontoons, however, are preferably formed such that the forward end and the rear ends taper upwardly at an angle with respect to the main body of the pontoon. Although the pontoons may be fixedly mounted to the outer ends of the outriggers arms, in some embodiments, the pontoons may be adjustably mounted to the outrigger arms. Such mounting may either be a manually adjustable mechanism for altering the pitch or angle of the pontoons relative to a horizontal plane or a separate motor mounted at the end of each of the outrigger arms and connected so as to automatically change the pitch of the pontoons.

In a preferred embodiment, the interior of the housing is divided into two compartments. A first compartment is designed and adapted to receive one or more batteries which are utilized to power the control mechanism and may also be utilized as a source of power for small electric motors which may be attached at one or more points along the hull of the watercraft. Preferably, two batteries are provided so that an auxiliary source of power is always available in the event of an emergency. The second compartment serves as an assembly area for the control mechanism for the outrigger arms and pontoons. In the preferred embodiment, an activation cylinder is mounted within the second compartment. The cylinder is connected to a lever extending from a central pivot shaft mounted intermediate the pivot shafts associated with the outrigger arms. The lever has opposed end portions on opposite sides of the central shaft which are pivotally secured to linkages which extend to pivot connections extending from each of the pivot shafts associated with the outrigger arms. As the cylinder is activated to either extend or retract a rod associated therewith, the linkage assembly pivots about the central shaft thereby pivoting the outrigger arms simultaneously upwardly or downwardly depending upon the movement of the extension rod.

The invention further provides a control panel mounted on an outer face of the housing. The control panel allows the selective activation of exterior motors, a motor associated with the electrical cylinder associated with the outrigger assembly and, in one embodiment, a switch for controlling the pontoon pitch angle to vary the angle between predetermined values.

It is the primary object of the present invention to provide a very compact and easily installable stabilization pontoon assembly which may be utilized with a canoe or other small watercraft to stabilize the watercraft during periods when the operator must shift his or her weight, such as while fishing, but wherein the stabilization floats or pontoon may be easily and quickly raised to permit movement of the craft through the water without the adverse drag of the pontoons.

It is a further object of the present invention to provide a stabilization pontoon assembly for conventional small watercraft which can be installed without modification to the craft structure.

It is a further object of the present invention to provide a stabilization pontoon assembly for use with small watercraft wherein the floats or pontoons associated with the assembly may be vertically raised and lowered depending upon the requirements of the operator and wherein the pitch angle of the pontoons may also be selectively adjusted to facilitate both maneuverability as well as stability of the craft during use.

BRIEF DESCRIPTION OF THE DRAWINGS

FIG. 4 is an enlarged partial cross-sectional view having portions broken away taken along line 4—4 of FIG. 3.

FIG. 5 is a cross-sectional view taken along line 5—5 of FIG. 4.

FIG. 12 is a cross-sectional view taken along line 12—12 of FIG. 4 showing the control panel assembly associated with the housing of the present invention.

DESCRIPTION OF THE PREFERRED EMBODIMENTS

Figure 1:
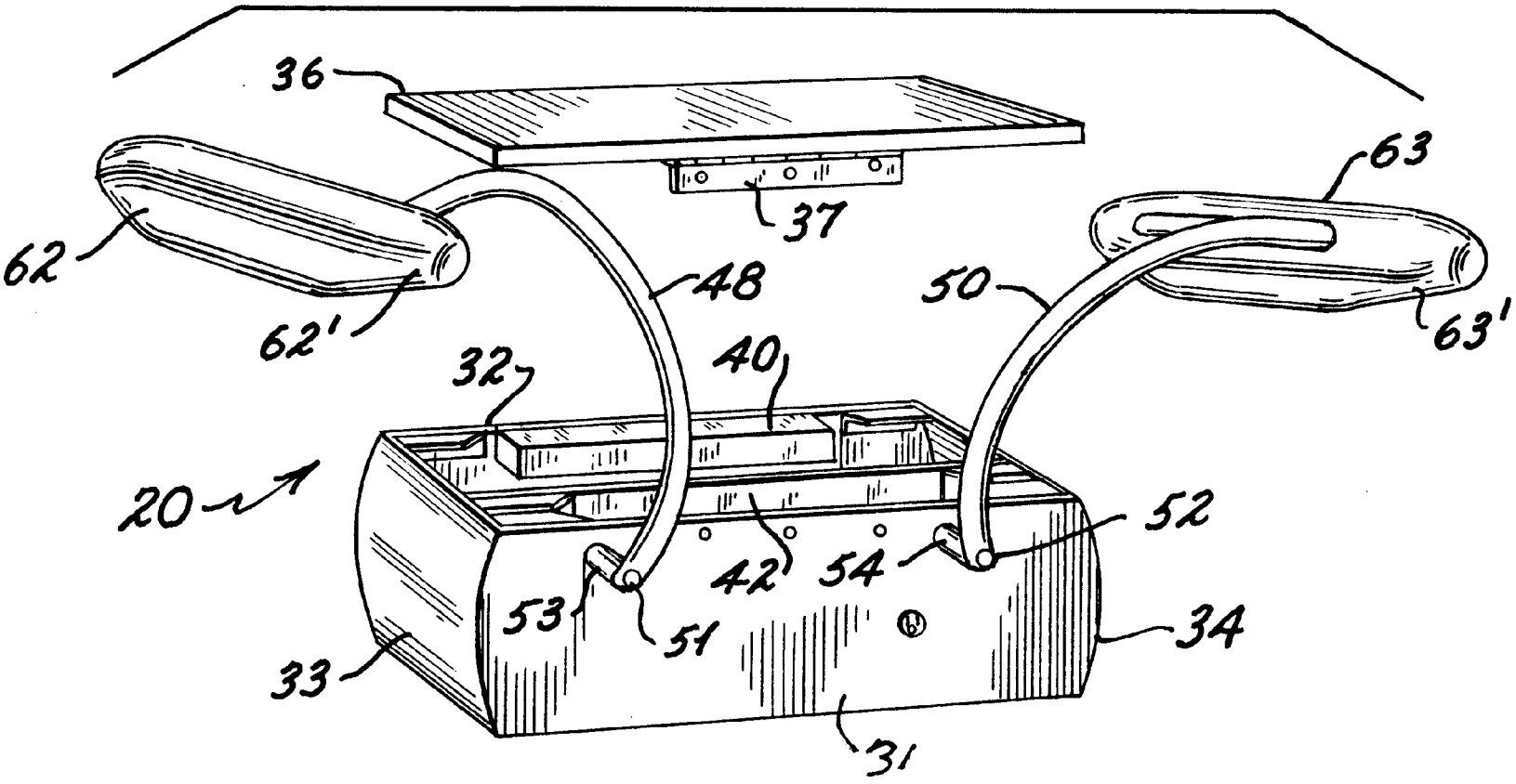
FIG. 1 is a perspective assembly view of a preferred embodiment of the present invention showing the stabilization assembly compactly housed within a housing which may be easily installed within the hull of a canoe or small watercraft.
Figure 2:
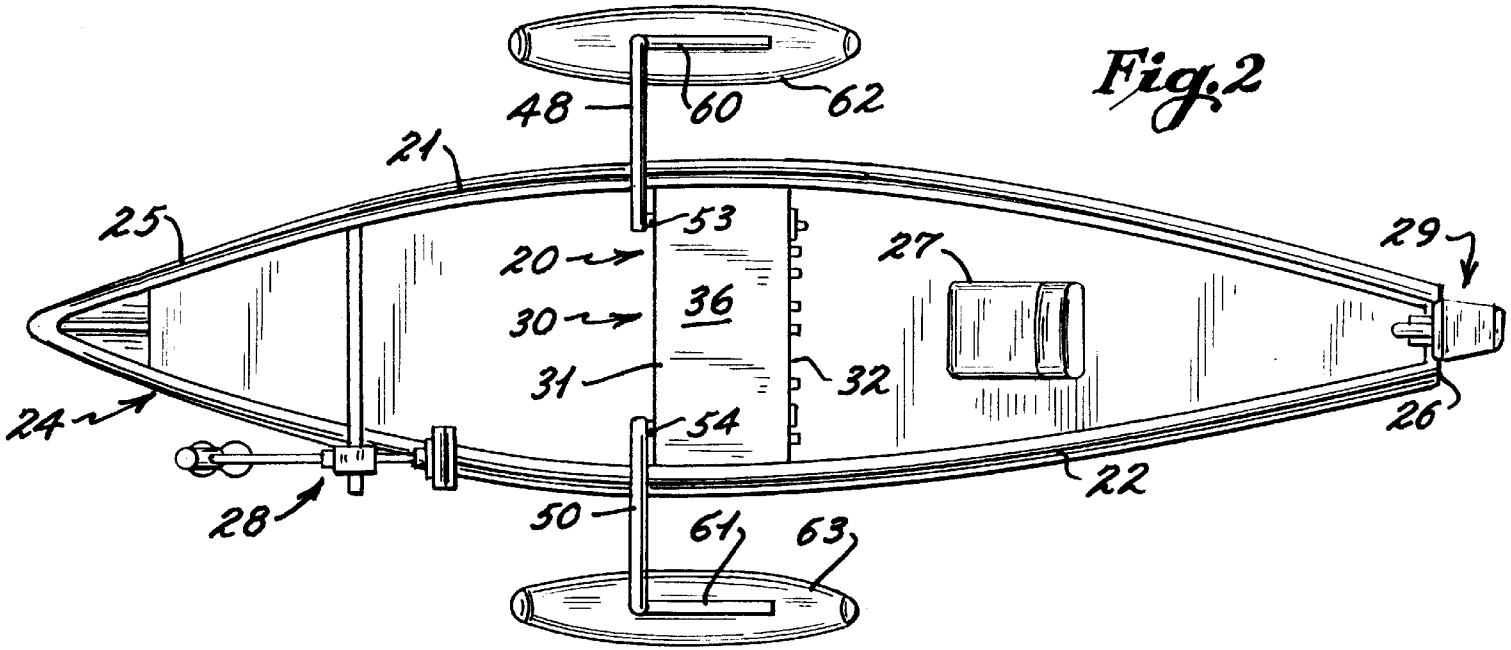
FIG. 2 is a top plan view of a canoe showing the stabilization assembly of FIG. 1 installed therein showing the outrigger floats or pontoons extending outwardly beyond the sidewalls of the watercraft.
Figure 3:
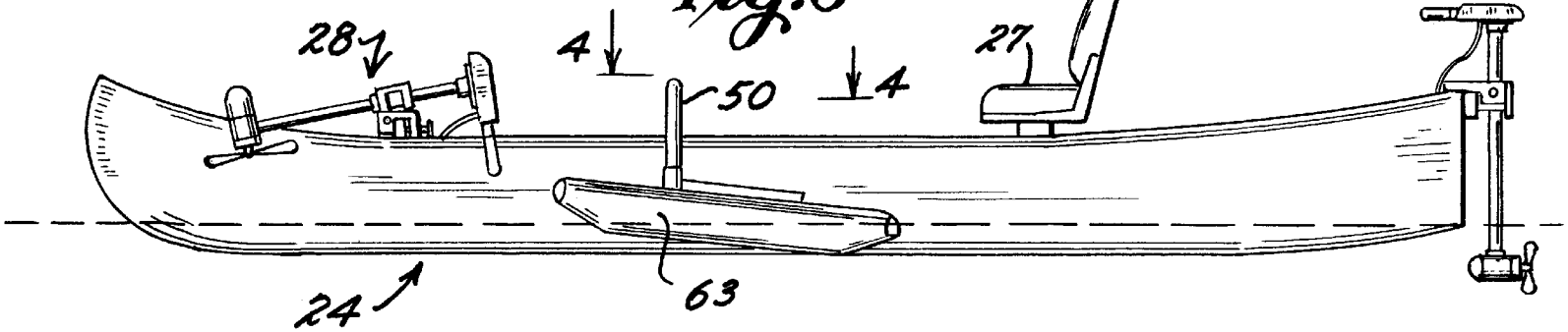
FIG. 3 is a view taken from the left side of the canoe shown in FIG. 2 showing one of the pontoons being deployed in a lower stabilizing position in contact with the surface of the water.

With continued reference to the drawing figures and particularly FIGS. 1–3, the stabilization pontoon assembly 20 of the present invention is shown as being mounted between the sidewalls 21 and 22 of a canoe 24 having a bow 25 and a stern portion 26. For purposes of further example, the canoe may include one or more seats 27 utilized specifically for fishing and may also incorporate one or more trolling motors such as shown at 28 and 29 which are mounted to one of the sidewalls and the stern wall of the canoe. The stabilization assembly is particular beneficial for stabilizing the canoe in the event a person seated on the seat 27 is fishing and must shift his or her weight. The assembly will ensure that the canoe remains stable regardless of movement of the individual and will also provide stability in the event they are waves developed by naturally occurring winds or by passing motor craft. Although the present invention is shown as being used with a canoe, the stabilization assembly may be used with other types of small watercraft.

The stabilization pontoon assembly 20 includes a housing 30 which is shown in FIG. 1 as having a rear wall 31, front wall 32, and opposite generally arcuate sidewalls 33 and 34. The upper portion of the housing is closed by a lid 36 which functions as an additional seat or for a work surface when the assembly is installed within the canoe. The lid 36 is connected by a hinge assembly 37 to the rear wall 31 of the housing. It should be noted that, in some embodiments, the housing may exclude the sidewalls 33 and 34 under which circumstances the sidewalls of the canoe will function as the end closures for defining the internal compartments of the housing, as will be described in greater detail hereinafter. Although not shown in the drawing figures, a gasket or seal may be provided along the interior surface of the lid 36 so as to ensure that the interior of the housing is substantially water tight when the lid is closed. The housing may also include a bottom wall 38 as shown in drawing FIGS. 5 and 6. In the preferred embodiment of FIG. 1, the housing is easily secured by fasteners, not shown, to the gunwale on opposite sides of the canoe.

With particular reference to FIG. 4, the interior of the housing 30, in the preferred embodiment, is divided into two compartments 40 and 42 by an interior wall 43. In some embodiments, the compartments 40 and 42 may be combined. The compartment 40 is designed to be adapted to allow one or more batteries 44 and 45 to be mounted therein and electrically connected through appropriate cables to a control panel assembly 46 associated with the stabilizer assembly, as shown in FIG. 12. The compartment 40 is designed to protect the batteries from becoming wet when in use. It is preferred that at least two batteries be provided so that one of the batteries may be utilized as an auxiliary source of power in the case of an emergency.

The mechanics for controlling the stabilizer assembly of the present invention are generally housed within the compartment 42. The stabilizer assembly includes a pair of outrigger arms 48 and 50 which are connected at their inner end portions, as shown at 51 and 52, respectively, to a pair of pivot shafts 53 and 54 which are supported within opposing bearing assemblies 55 and 56 and 57 and 58, respectively. The outer ends of each of the pivot shafts 53 and 54 extend through the rear wall 31 of the housing to the points of connection 51 and 52 with the outrigger arms 48 and 50. In some embodiments, it is envisioned that the pivot shafts 53 and 54 may be integrally formed with the outrigger arms 48 and 50.

Support brackets or rods 60 and 61 are attached to or formed with the outrigger arms 48 and 50 are designed to extend generally laterally away and downwardly at an angle from the outer portions of the outrigger arms 48 and 50, as shown in drawing FIG. 4. The brackets 60 and 61 are secured to the upper surface of a pair of floats or pontoons 62 and 63. The pontoons may take various configurations and be formed of a variety of materials. By way of example, each pontoon may be formed of a closed aluminum cylinder or of an aluminum body having a rounded base portion and a generally flat upper portion. The interior of the pontoon may be hollow. As opposed to using aluminum bodies, it is possible that a closed cell foam material may be utilized for the pontoons. In the preferred embodiment, at least the forward or nose portion of each pontoon includes an upwardly tapered portion.

With specific reference to FIGS. 1 and 5, the configuration of the outrigger arms 48 and 50 is such that they are somewhat arcuate in configuration. Other configurations may be utilized so long as the shape permits the outriggers to extend upwardly from the housing 30 and over the sidewalls 21 and 22 of the canoe and then downwardly to the pontoons 62 and 63.

Figure 7:
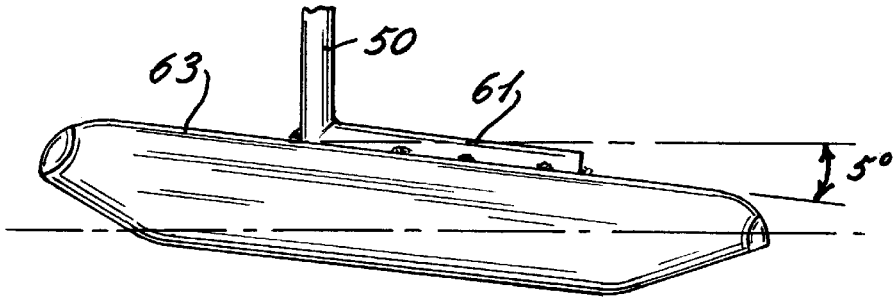
FIG. 7 is a side illustrational view showing one of the pontoons deployed relative to the surface of the water and showing the pitch adjustment angle of the pontoon in accordance with the teachings of the invention.

With specific reference to FIG. 7, in the embodiment shown in FIGS. 1–5, the pontoons 62 and 63 are fixedly mounted to the brackets 60 and 61 extending from the outrigger arms 48 and 50. When in a fixed configuration, it is preferred that each pontoon are pitched vertically upward relative to a horizontal axis at approximately 5° as is shown in drawing FIG. 7. This will assist in the maneuverability of the canoe in the event power is applied through one of the motors 28 and 29 when the pontoons are in a fully deployed position as shown in drawing FIG. 7.

Figure 8:
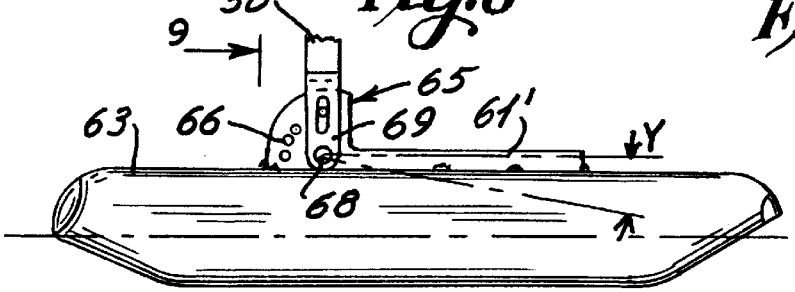
FIG. 8 is a view similar to FIG. 7 showing a first form of adjustable mounting between an outrigger arm and one of the pontoons of the present invention to allow pitch adjustment to the pontoon.
Figure 9:
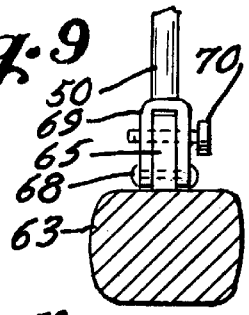
FIG. 9 is a cross-sectional view taken along line 9—9 of FIG. 8.

One of the further advantages of the present invention are embodiments shown in FIGS. 8–11. In these embodiments, each pontoon is designed to be mounted so as to have an adjustable pitch angle with respect to the outrigger arms 48 and 50. In this embodiment, the pontoon connecting rods or brackets, such as shown in FIG. 8 at 61', include a bracket assembly 65 having a plurality of openings 66 formed therein in arcuate relationship with respect to one another. The pontoon exemplified in FIG. 8 at 63 is connected to the outrigger arm 50 by a pivot connection 68 which includes a U-shaped yoke member 69 welded or otherwise secured to the end portion of the outrigger arm 50. The yoke member 69 includes a pair of aligned openings therein through which a locking pin 70 may be selectively extended after passing through one of the openings 66 in the bracket 65, as shown in FIG. 9. In this manner, the pitch angle "X" may be varied depending upon the desired planing action to be developed by the pontoons 62 and 63 when in use.

Figure 11:
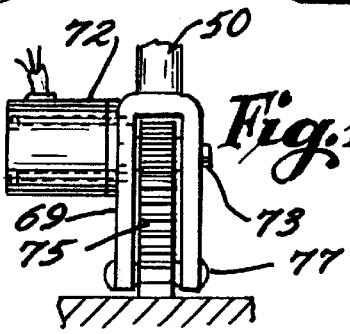
FIG. 11 is a partial cross-sectional view taken along line 11—11 of FIG. 10.

To automatically adjust the pitch angle "X" of the pontoons relative to the surface of the water, without requiring manual adjustment, a separate small electric motor, such as shown in FIG. 11 at 72, may be mounted to each of the U-shaped brackets 69 and electrically connected to a source of power, such as one of the batteries 44 and 45. Each electric motor 72 includes an output shaft 73 having a cogwheel 74 mounted thereto which is enagageable with spaced teeth 75 provided along the outer surface of a reconfigured bracket 76 connected to the pontoon support member or bracket 61". The U-shaped bracket 69 is pivotally connected at 77 to the base portion of the bracket 76. By operation of the motor 72, the cogwheel 74 will automatically rotate the pontoon bracket 61" by engagement with the teeth 75 of the bracket 76 to a desired pitch angle. In this manner, the operator may control the pitch angle without having to shift his or her weight in the boat by simply using the appropriate control switches for adjusting the pitch angle, as will be described in greater detail hereinafter.

Figure 6:
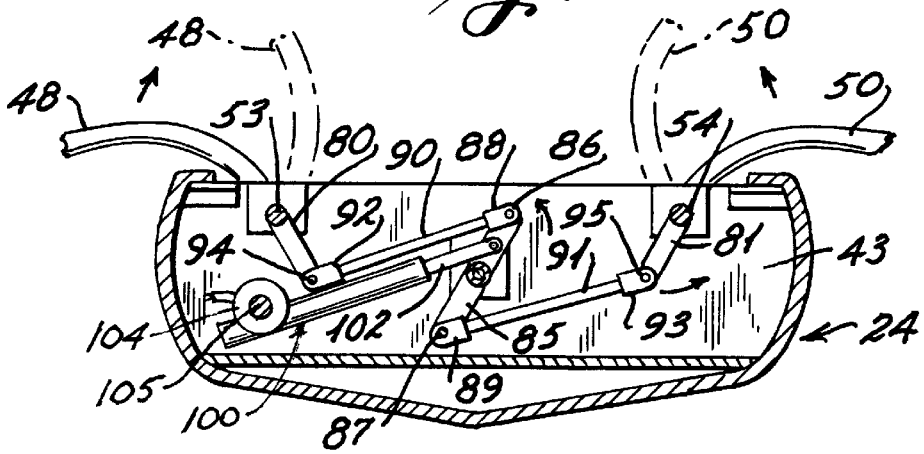
FIG. 6 is a cross-sectional view taken along line 6—6 of FIG. 4 showing the activation cylinder and linkage assembly for controlling the movement of the outrigger arms to raise and lower the floats or pontoons associated with the stabilization assembly of the present invention.

With particular reference to FIGS. 4–6, the drive assembly for operatively elevating or deploying the pontoons 62 and 63 will be described in greater detail. Each pivot shaft 53 and 54 includes a crank arm 80 and 81, respectively, which is fixedly secured thereto and extends outwardly therefrom. A central pivot shaft 82 is mounted intermediate and parallel to the pivot shafts 53 and 54 and is supported by bearing assemblies 83 and 84 mounted to the intermediate wall 43 and rear wall 31 of the housing, respectively. A double crank arm 85 is fixedly secured to the pivot shaft 82 and includes opposite end portions which are pivotally connected at 86 and 87 to generally U-shaped yoke members 88 and 89, respectively, at one end of a pair of link members 90 and 91. The opposite end of each of the link members 90 and 91 includes another U-shaped yoke member 92 and 93, respectively, which are pivotally connected at 94 and 95 to the outer ends of each of the crank arms 80 and 81, respectively.

In order to raise the outrigger arms 48 and 50 from the full line position shown in FIG. 6 to the dotted line position shown therein to move the pontoons from a deployed to a raised position, an activation cylinder 100 is provided having an extendable rod 102 associated therewith. In the present embodiment, the cylinder 100 includes an electrically operated extension rod which is driven by a motor 104 having a drive cogwheel 105 associated therewith. The cogwheel drives cooperating teeth (not shown) associated with the extension rod 102. The cylinder 100 and motor 104 are mounted to bracket members within the component chamber 42. Upon activation of the motor 104, the extension rod 102 may be extended from the position shown in FIG. 6 thus withdrawing the piston rod toward the cylinder 100. This action causes the double crank arm 85 to pivot with the pivot shaft 82 counterclockwise, as shown by the arrow in the drawing figure. This action pushes the link members outwardly thus pivoting the outrigger arms 48 and 50 upwardly as shown in dotted line in the drawing figure. By reversing the direction of the drive motor 104, the outrigger arms 48 and 50 may be lowered thus redeploying the pontoons 62 and 63 relative to the sidewalls of the canoe. The motor may be stopped at substantially any position thus regulating the effective vertical displacement of the pontoons and relative to the sidewalls of the canoe. Appropriate limit switches are associated with the control circuitry to prevent outrigger arms 48 and 50 from engaging and otherwise damaging the upper edge portion of the sidewalls of the canoe when the stabilizer assembly of the present invention is in use and for further limiting the upward angle of the pontoons when the pontoons are elevated with respect to the sidewalls of the canoe, as shown in dotted line in FIG. 5.

Figure 10:
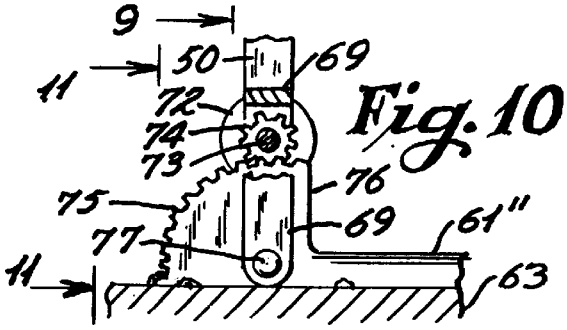
FIG. 10 is a side illustrational view of a second embodiment for controlling the pitch angle of the pontoon shown in FIG. 7 incorporating a motor assembly.

With specific reference to FIGS. 12 and 13, the control circuitry of the present invention will be described in greater detail. The control panel shown in FIG. 12 discloses an "ON/OFF" switch 110 for providing power to an electrical circuit which may be utilized to supply electrical energy from the batteries 44 and 45 to the trolling motors shown at 28 and 29 and to the motor 104 associated with the outrigger control cylinder 100. The amount of voltage of the batteries may be displayed on an appropriate gauge 112. A choice of battery for purposes of supplying power is possible through a selector switch 114. Appropriate control buttons 116 and 117 are provided for activating the motor 104 for purposes of raising and lowering the outrigger arms. A separate selector switch 118 is provided to control the motors 72 associated with the pitch adjustment assemblies connecting the outrigger arms to each of the pontoons, as shown in FIGS. 10 and 11. By setting the appropriate degree angle on the control panel, such as between 0°–10°, the pontoon pitch will be changed accordingly. Auxiliary switches 120 and 121 are provided for allowing the batte ries 44 and 45 to be connected to a bilge pump or to an auxiliary electrical device, such as a depth gauge or a light assembly utilized with the watercraft. Also supplied on the control panel are a pair of electrical outlets 123 and 124 which may be utilized to connect the supply power to an exterior motor, such as trolling motors 28 or 29. In the preferred embodiment, a further electrical receptacle 125 is provided through the rear wall of the housing for facilitating the connection of a trolling motor attached to the canoe in close proximity to the rear wall of the housing.

Figure 13:
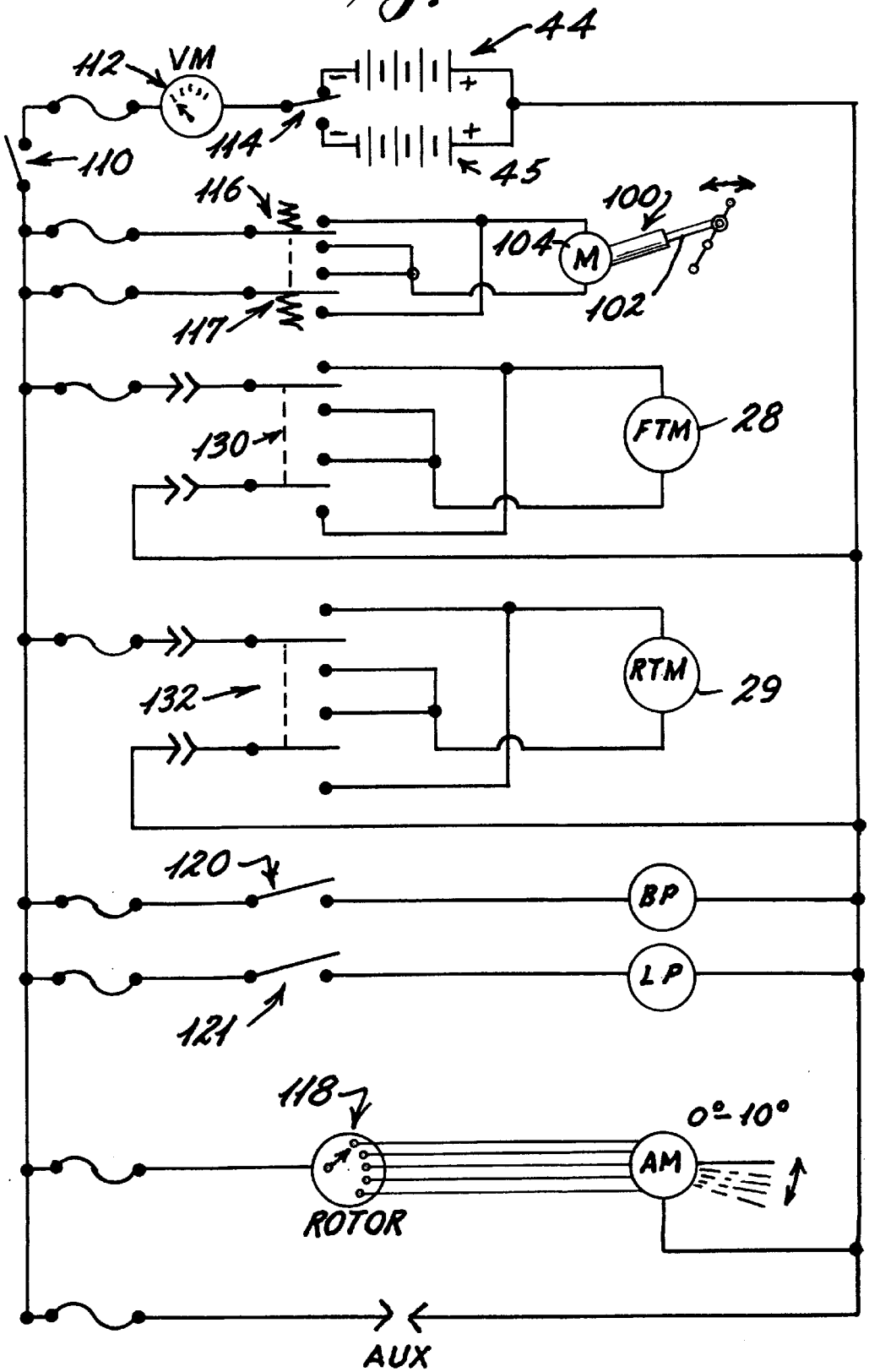
FIG. 13 is an electrical circuit diagram of the stabilization assembly control panel of the present invention.

FIG. 13 is a simplified electrical schematic diagram showing the relative connections between the batteries 44 and 45 and the forward and rear trolling motors 28 and 29, the cylinder adjustment motor 104 for controlling the vertical positioning of the pontoons 62 and 63 and the switch 118 for controlling the pitch angle motor 72 associated with each outrigger arm 48 and 50.

In use, the stabilizer assembly 20 of the present invention may easily be mounted between the sidewalls of a canoe and may be adapted for other small watercraft. Once installed, batteries such as 44 and 45 may be easily connected to the switches associated therewith. With the batteries installed, and by activating the "ON/OFF" switch 110 and the outrigger control arm switches 116 and 117, it is possible to raise and lower the outrigger arms and adjust the pontoons 62 and 63, respectively as required. Normally, when it is desired to provide maximum stabilization, the pontoons are lowered into engagement with the water as is shown in FIG. 3 and in full line in FIG. 5. To allow maneuverability and increased speed, the pontoons may be easily raised by activating the switch 116 to raise the outrigger arms and thus the pontoons to the dotted line position shown in FIG. 5. To further adjust the planing angle of the bow of the boat through the water, the pitch angle of each of the pontoons may likewise be varied. By activation of the control switch 118, the motors 72 may be utilized to adjust the pitch angle of the pontoons between 0°–10° or more from the horizontal. In the mechanical embodiment, the pontoons may be preadjusted before the canoe is placed into use utilizing the embodiment shown in FIGS. 8 and 9. As shown in FIG. 13, appropriate hand or foot switches 130 and 132 may also be connected to control operation of the motors 28 and 29.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

I claim:

1. A stabilizer assembly adapted for use with a small watercraft having opposite sidewalls and front and rear ends and wherein the watercraft may be powered by a motor mounted thereto, the stabilizer assembly comprising; a housing of a size to be seated within the watercraft and between the sidewalls thereof, a pair of pivot members mounted within said housing and extending outwardly thereof, a pair of outrigger arms connected to said pivot members and extending upwardly and outwardly relative to said housing and being adapted to extend over and beyond the sidewalls of the watercraft when the housing is mounted therein, each of said outrigger arms having outer portions connected to a pontoon, said housing defining at least one interior chamber in which an activation means is mounted, a first switch means mounted to said housing for selectively activating said activation means when said activation means is connected to a source of electrical power, drive means connecting said activation means to said outrigger arms whereby said arms may be selectively raised or lowered by said activation means, whereby said first switch means may be selectively activated to raise or lower said outrigger arms to raise and lower said pontoons relative to the sidewalls of a watercraft when said housing is mounted therein.

2. The stabilizer assembly of claim 1 including a pitch adjustment means mounted between each of said pontoons and said outrigger arms for selectively altering the pitch angle of said pontoons relative to a horizontal plane.

3. The stabilizer assembly of claim 2 in which said pitch adjustment means includes a bracket member secured to each of said pontoons, each of said outrigger arms having an outer end portion pivotally connected to said bracket members and securing means for securing said outer end portion of each said outrigger arms to said bracket members in spaced relationship from said pivot members.

4. The stabilizer assembly of claim 3 in which each of said outer end portions of said outrigger arms includes a connector member, said bracket member connected to each of said pontoons including a plurality of spaced openings therein, said securing means including a pin means extending through a selected one of said openings in said bracket members for securing said bracket members to said connector members of said outrigger arms.

5. The stabilizer assembly of claim 2 wherein said pitch adjustment means includes a motor means drivingly connected between said outrigger arms and said pontoons.

6. The stabilizer assembly of claim 5 wherein said each of said motor means is mounted adjacent said outer end portion of each of said outrigger arms, a bracket assembly mounted to each of said outriggers arms and having a plurality of spaced teeth extending therefrom, said motor means including a drive output engageable with said teeth of said bracket assembly whereby activation of said motor means will rotate said bracket assembly relative to said motor means to thereby adjust the pitch angle of said pontoons.

7. The stabilizer assembly of claim 5 wherein said housing includes a second switch means and means for electrically connecting said second switch means to a source of electrical power to each of said motor means drivingly connected between said outrigger arms and said pontoons.

8. The stabilizer assembly of claim 1 in which said drive means includes a central pivot shaft mounted intermediate said pair of pivot members, a double crank arm mounted to said central pivot shaft and having a pair of spaced outer end portions, a pair of link members pivotally mounted to said outer end portions of said double crank arm, a crank arm mounted to each of said pair of pivot members and means for connecting said outrigger arms to opposite ends of each of said first and second link members, and said activation means being connected to rotate said pivot shaft through said double crank arm.

9. The stabilizer assembly of claim 8 in which said activation means includes an extension rod, and means for extending said extension rod.

10. The stabilizer assembly of claim 9 in which said means for extending said extension rod includes a motor including an output drivingly connected to said extension rod.

11. The stabilizer assembly of claim 10 wherein each of said pivot members is connected to walls of said housing by pairs of spaced bearing supports.

12. The stabilizer assembly of claim 1 in which said housing includes first and second compartments, said first compartment being adapted to receive at least one battery therein, said first switch means electrically connecting the at least one battery to said activation means, and said activation means and said pivot members being mounted within said second compartment.

13. The stabilizer assembly of claim 12 including a lid means associated with said housing, means for securing said lid means to said housing so as to seal said first and second compartments to prevent water from entering therein.

14. The stabilizer assembly of claim 13 including electrical connectors extending through a sidewall of said housing.

15. A stabilizer assembly adapted for use with a small watercraft having opposite sidewalls and front and rear ends, the stabilization assembly comprising; a housing of a size to be adapted to be seated within the watercraft and between the sidewalls thereof, said housing including first and second compartments, said first compartment including means for electrically connecting a battery supply therein, a pair of pivot means mounted within said second compartment and extending outwardly through a sidewall of said housing in spaced relationship with respect to one another, a pair of outrigger arms pivotally connected at one end to said pivot means outwardly of said housing and having outer ends extending upwardly and outwardly relative to said housing so as to be disposed beyond the sidewalls of the watercraft when the housing is mounted within the watercraft and between the sidewalls thereof, means for connecting outer end portions of each of said outrigger arms to a pontoon, an electrical drive means mounted within said housing for driving said pivot means so as to selectively raise and lower said outrigger arms to thereby raise and lower said pontoons connected thereto.

16. The stabilizer assembly of the claim 15 including means for pivotally adjusting each of said pontoons relative to each of said outrigger arms.

17. The stabilizer assembly of claim 16 in which said means for pivotally adjusting said pontoons includes a pitch adjustment motor means mounted intermediate said outrigger arms and said pontoons, each of said pitch adjustment motor means having a drive output for altering the pitch of said pontoons relative to said outrigger arms and control means mounted to said housing for activating said pitch adjustment motor means.

* * * * *